US005425690A

United States Patent [19]

Chang

[11] Patent Number: 5,425,690

[45] Date of Patent: Jun. 20, 1995

[54] WRIST EXERCISER

[76] Inventor: Sreter Chang, No. 451 Ta Tien Road, Homei Chen, Chang Hua Hsien, Taiwan, Prov. of China

[21] Appl. No.: 230,377

[22] Filed: Apr. 20, 1994

[51] Int. Cl.[6] ..... A63B 23/14; A63B 21/02

[52] U.S. Cl. ..... 482/46; 482/121; 482/124; 482/128

[58] Field of Search ..... 482/44, 45, 46, 121, 482/122, 124, 128

[56] References Cited

U.S. PATENT DOCUMENTS

| | | | |
|---|---|---|---|
| 2,106,994 | 2/1938 | Chapman | 482/128 |
| 4,589,655 | 5/1986 | Ammon | 482/46 |
| 4,834,366 | 5/1989 | Hotchkiss | 482/128 |

*Primary Examiner*—Richard J. Apley
*Assistant Examiner*—Lynne A. Reichard
*Attorney, Agent, or Firm*—Bacon & Thomas

[57] ABSTRACT

An exerciser includes a support for supporting the arm of a user and a hand grip pivotally coupled to the support. A tube is fixed to the support. Two discs are slidably disposed in the tube. A spring is biased between the discs. A cable connects the hand grip to a disc distal to the hand grip. The hand grip is moved away from the tube against the spring force for training the wrist portion. A bolt is rotatably disposed in the tube and is threadedly engaged with the disc close to the hand grip. The two discs are moved toward or away from each other for adjusting the biasing force of the spring.

4 Claims, 7 Drawing Sheets

WRIST EXERCISER

BACKGROUND OF THE INVENTION

1. Field of the Invention

The present invention relates to an exerciser, and more particularly to a wrist exerciser.

2. Description of the Prior Art

Various kinds of exercising mechanisms have been developed for exercising both upper and lower muscle groups of the users. However, as far as applicant is aware, no exercising mechanisms are provided for training the muscle group of the wrist.

The present invention has arisen to provide a wrist exerciser for training the muscle group of the wrist.

SUMMARY OF THE INVENTION

The primary objective of the present invention is to provide a wrist exerciser for exercising the wrist portion of the user.

In accordance with one aspect of the invention, there is provided a wrist exerciser comprising a support for supporting the arm, a hand grip pivotally coupled to the support, a tube including a first end fixed to the support and located close to the hand grip, and including a second end distal to the hand grip, a first disc slidably disposed in the tube, at least one cable connected between the first disc and the hand grip, and means for biasing the first disc away from the hand grip. The hand grip is moved away from the tube against the biasing means for training the wrist.

A barrel is further rotatably secured to the second end of the tube. A bolt is rotatably disposed in the tube and includes a first end located in the first end of the tube and a second end secured to the barrel and rotated in concert with the barrel. A second disc is threadedly engaged with the bolt, the biasing means between is disposed the first disc and the second disc, the and second disc is moved toward or away from the first disc when the bolt is rotated by the barrel so as to adjust the biasing force of the biasing means. The tube includes at least one slot formed in a longitudinal direction therein, the first disc and the second disc include at least one key for engaging with the slot so as to guide the first disc and the second disc to move along the longitudinal direction of the tube.

The first disc and the second disc each includes at least one notch formed therein for engaging with the cable, and the cable includes a head engaged with the first disc for engaging the cable with the first disc. The bolt includes a head formed on the second end thereof and secured to the barrel, and the tube includes two pins disposed in parallel in the second end thereof and engaged with the bolt close to the head thereof for allowing rotation of the bolt in the tube.

The barrel includes a plurality of recesses arranged in an annular circle therein, the tube includes a cavity formed in the second end thereof, a catch is engaged in the cavity, and means are provided for biasing the catch to engage with the recesses so as to maintain the control barrel in place relative to the tube.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
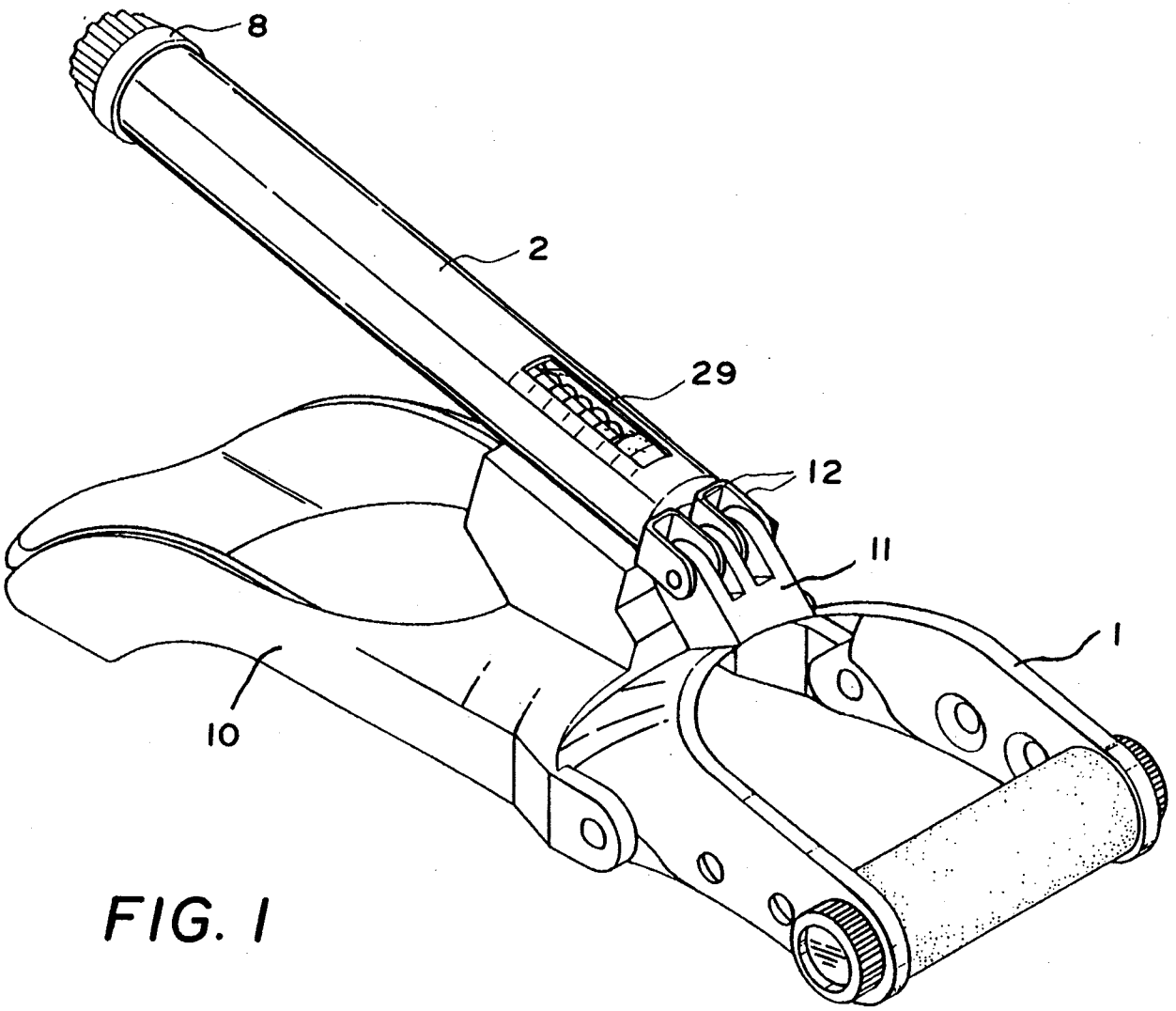
FIG. 1 is a perspective view of a wrist exerciser in accordance with the present invention.

Referring to the drawings, and initially to FIGS. 1 to 5, a wrist exerciser in accordance with the present invention comprises a support 10 for supporting the arm of a user, a hand grip 1 is pivotally coupled to the support 10 and includes a stub 11 extended therefrom. Two connectors 12 each includes two holes 121 for engaging with a pin 122 which is secured to the stub 11 such that the connectors 12 are pivotally coupled to the stub 11 of the hand grip 1. Two cables 3, each including an enlarged head disposed on one end thereof for engaging with the connectors 12 respectively, best shown in FIG. 3.

Figure 2:
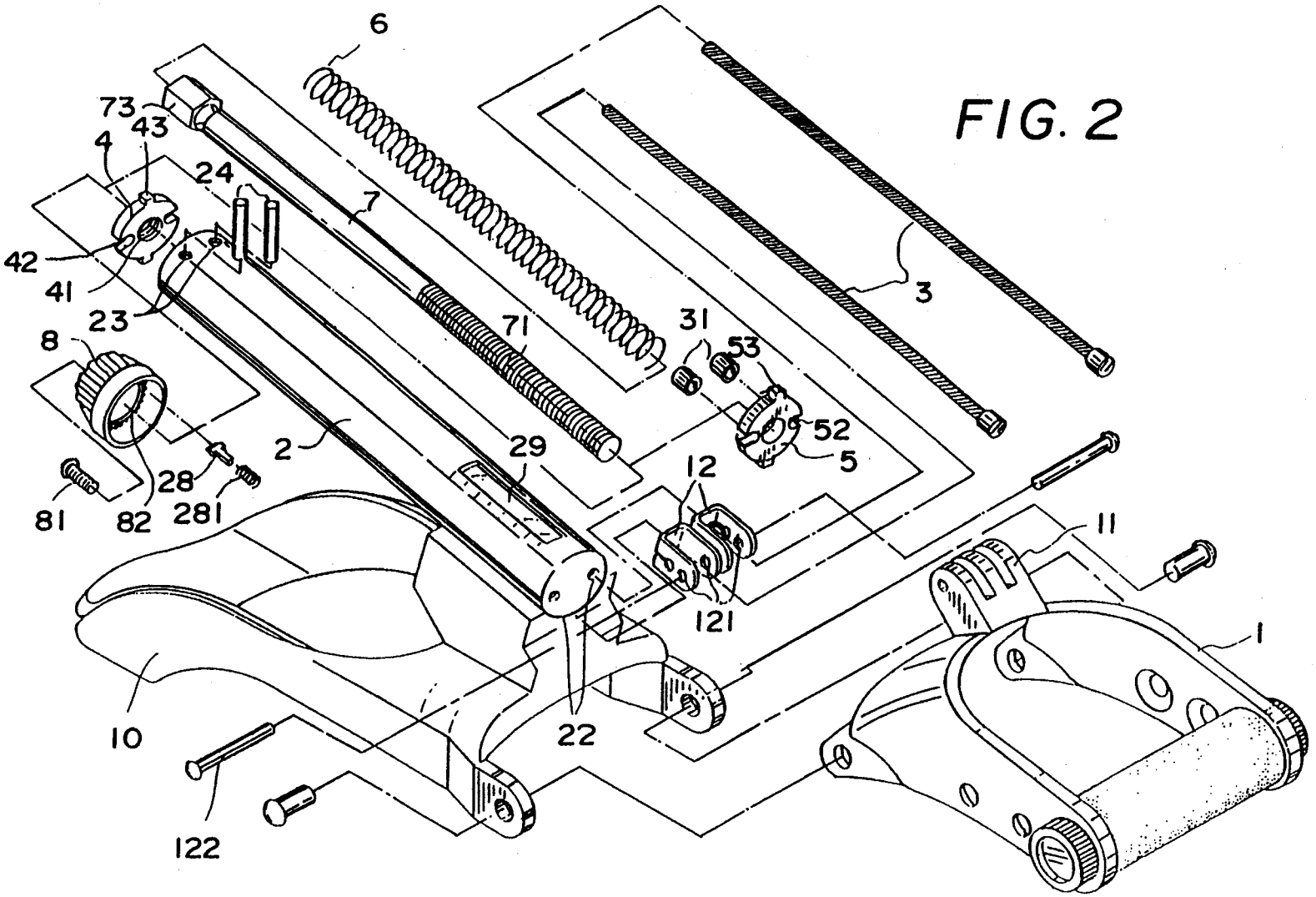
FIG. 2 is an exploded view of the wrist exerciser.
Figures 3, 4A, 4B:
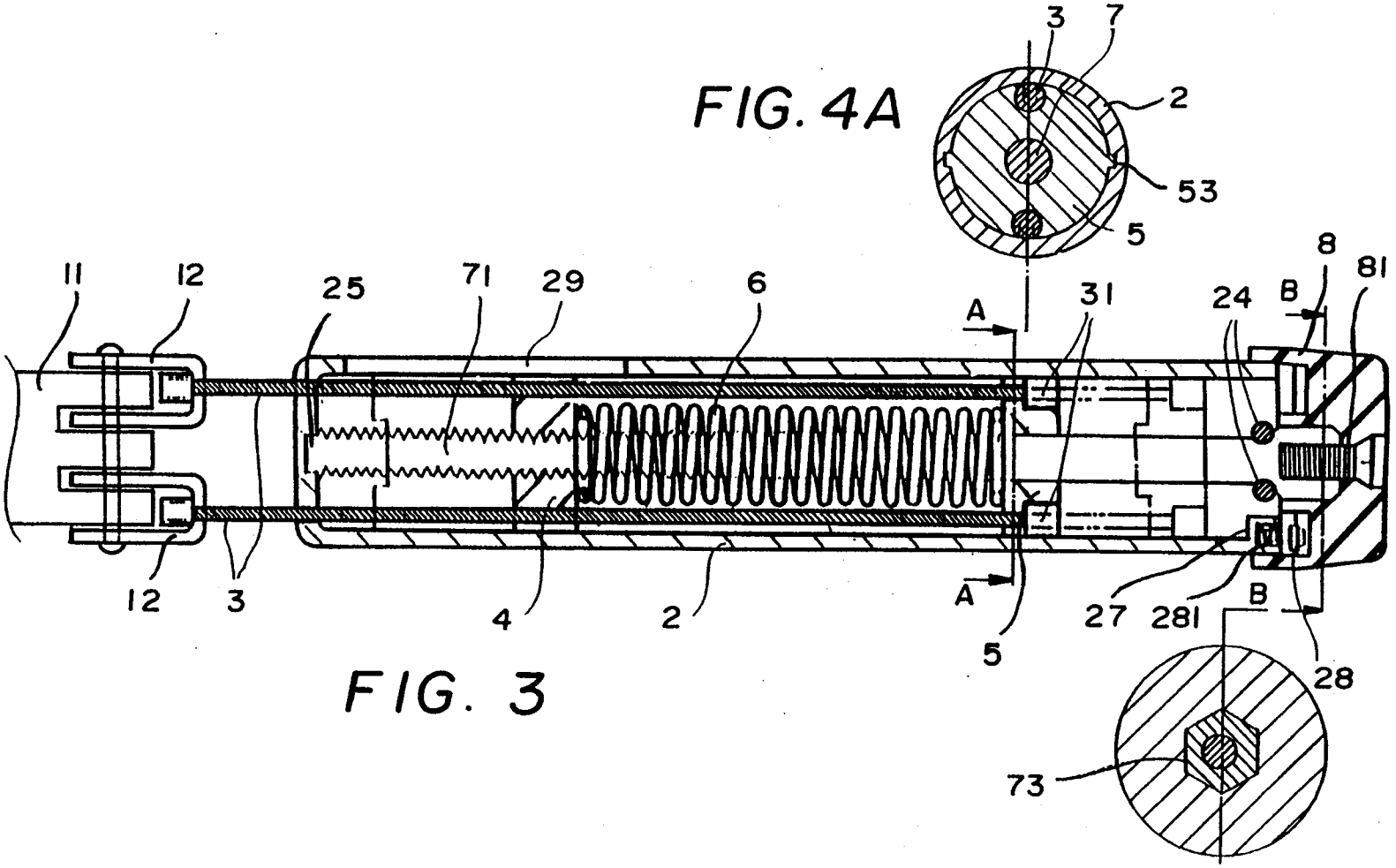
FIG. 3 is a cross sectional view of the wrist exerciser.
FIGS. 4A and 4B are cross sectional views taken along lines A—A and B—B of FIG. 3 respectively.

A tube 2 includes a first end fixed to the support 10 and located close to the connectors 12 and a second end having a control barrel 8 secured thereto. The tube 2 includes two holes 22 formed in the first end for inserting the cables 3. A window 29 is provided on top of the tube 2 for viewing the interior of the tube. Two discs 4, 5 are slidably disposed in the tube 2, each of the discs 4, 5 includes two opposite keys 43, 53 slidably engaged with two corresponding slots longitudinally formed in the tube 2, a best shown in FIG. 4A, such that the discs 4, 5 are guided to slide longitudinally within the tube 2 and will not rotate within the tube 2. The disc 4 is located in the first end of the tube 2 and includes an inner thread 41 formed therein. Each of the discs 4, 5 includes two notches 42, 52 for engaging with the cables 3. Two heads 31 are fixed on the other end of the cables 3 for engaging with the disc 5 as shown in FIG. 3. A bolt 7 includes a first end 25 rotatably engaged in the first end of the tube 2 and includes an outer thread 71 formed in the first end portion for threadedly engaging with the inner thread 41 of the disc 4. The disc 5 is slidably engaged on the middle portion of the bolt 7 and freely rotatable relative to the bolt 7. The bolt 7 includes a second end having a head 73 formed thereon for engaging in the control barrel 8. A screw 81 fixes the head 73 to the control barrel 8 such that the bolt 7 rotates in concert with the barrel 8. Two pins 24 are engaged through two orifices 23 formed in the second end of the tube 2 and engaged with the head 73 of the bolt 7 so as to stably retain the bolt 7 in place. A spring 6 is biased between the discs 4, 5. As shown in FIGS. 2 and 3, the control barrel. 8 includes a plurality of recesses 82 formed therein and arranged in an annular circle. A cavity 27 is formed in the second end of the tube 2 for receiving a catch 28 and a spring 281. The catch 28 is biased to engage with the recesses 82 by the spring 281 so as to maintain the control barrel 8 in place relative to the tube 2.

Figure 5:
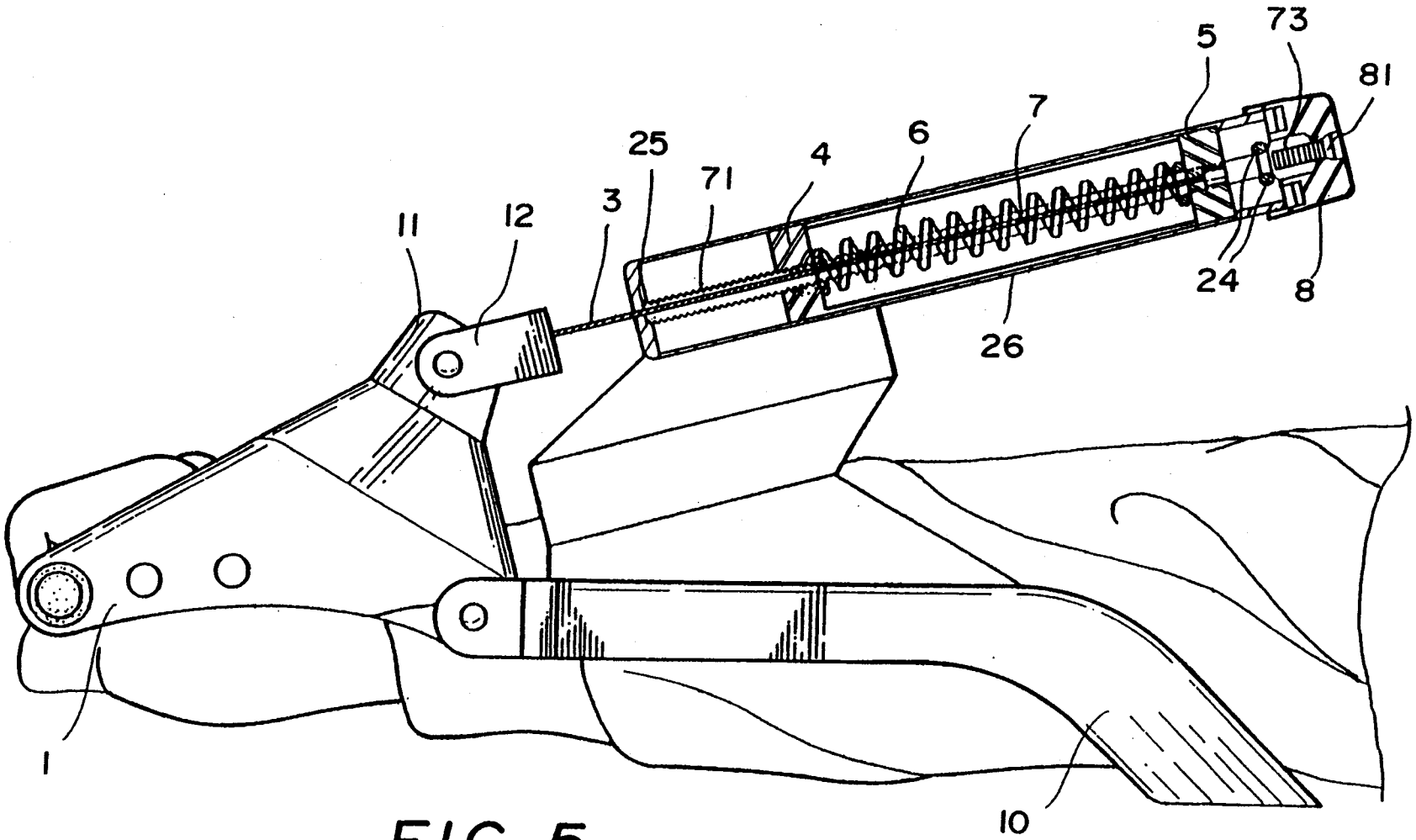
FIGS. 5, 6, 7, 8 are schematic views illustrating the operation of the wrist exerciser.
Figure 6:
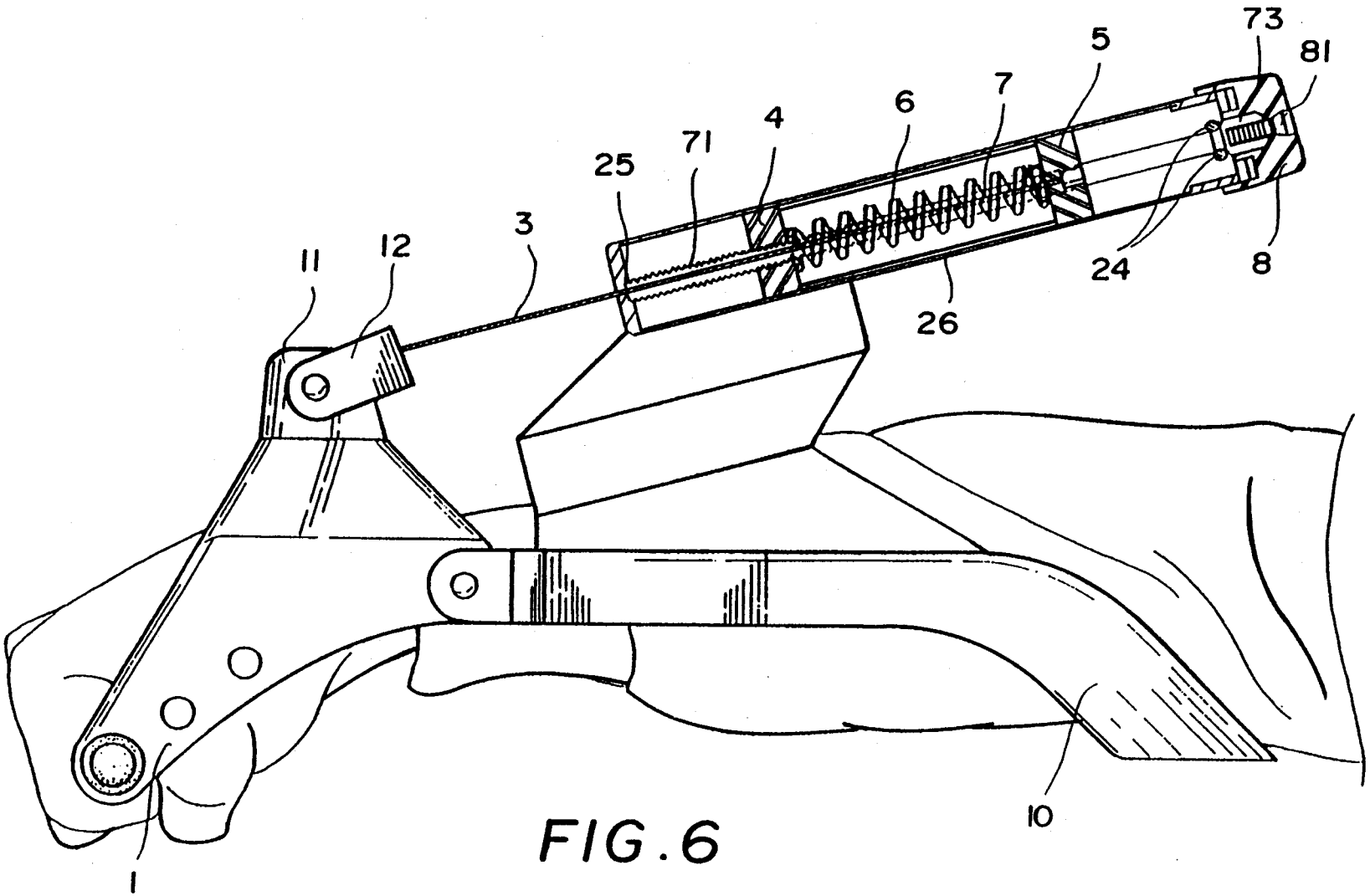
Figure 7:
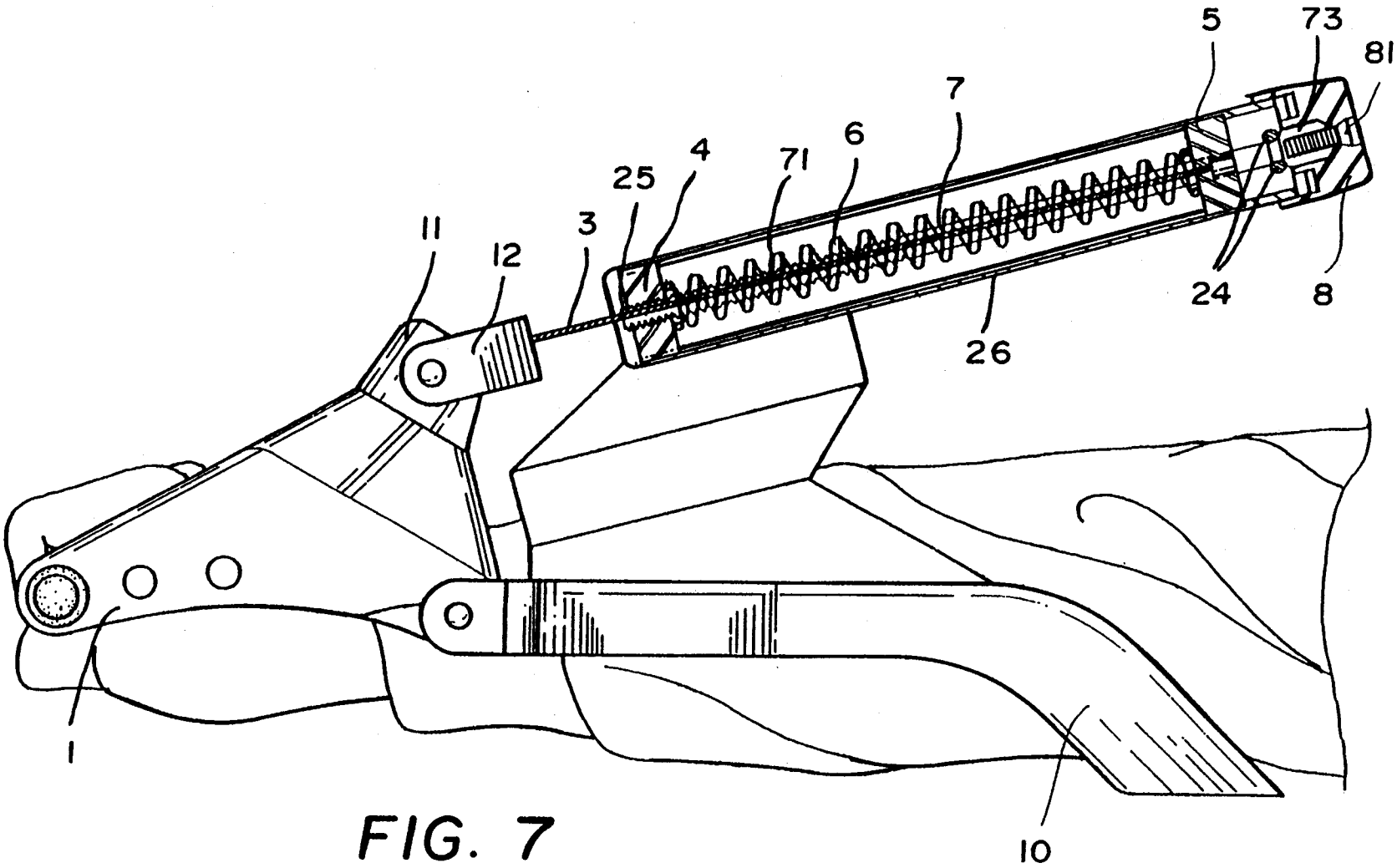
Figure 8:
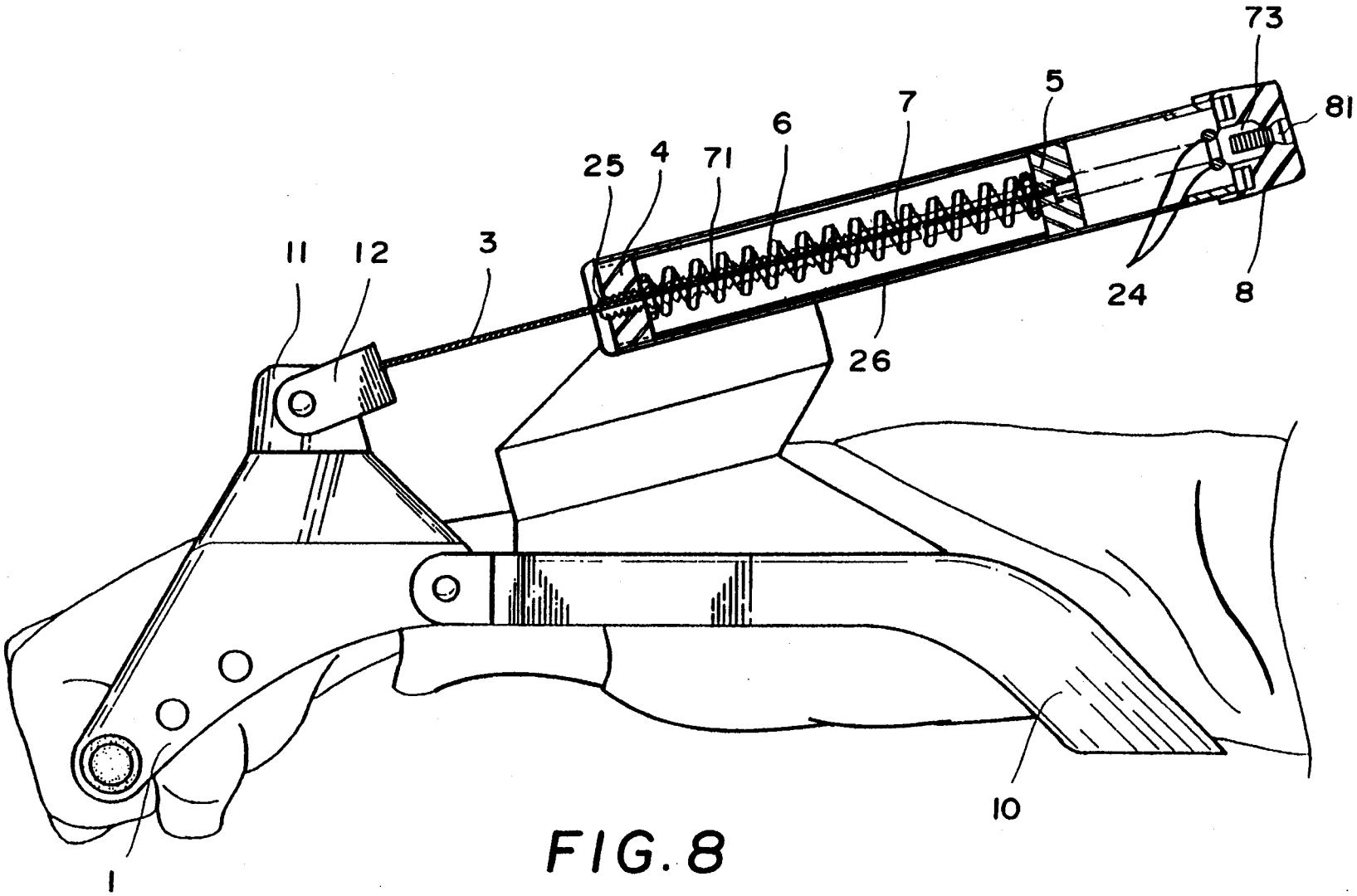

In operation, as shown in FIGS. 5 and 6, the arm of the user is supported in the support 10 and the hand thereof grips the hand grip 1, the wrist of the hand may be rotated against the biasing force of the spring 6 so as to train the wrist. As shown in FIGS. 7 and 8, the disc 4 may be moved toward or away from the other disc 5 when the bolt 7 is rotated by the control barrel 8 such that the tension or compression force of the spring 6 may be adjusted. The position of the disc 4 corresponds to the spring force of the spring 6 and may be seen through the window 29.

Accordingly, the wrist exerciser in accordance with the present invention may be suitably provided for training wrists.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A wrist exerciser comprising:

a) a support for supporting an arm of a user;

b) a hand grip pivotally coupled to the support;

c) a tube including a first end secured to the support adjacent the hand grip, a second end distal to the hand grip and at least one longitudinal slot formed therein;

d) a first disc slidably disposed in the tube for movement in a longitudinal direction, the first disc including at least one key engaging the longitudinal slot for guiding the movement of the first disc;

e) at least one cable connecting the first disc and the hand grip;

f) means for biasing the first disc away from the hand grip;

g) a barrel rotatably secured to the second end of the tube;

h) a bolt rotatably disposed in the tube and including a first end positioned at the first end of the tube and a second end secured to the barrel for rotation therewith; and i) a second disc threadedly engaged with the bolt and including at least one key engaging the longitudinal slot for sliding movement therealong, the biasing means being disposed between the first and second discs, and the second disc being moveable towards and away from the first disc upon rotation of the bolt by the barrel for varying the biasing force applied to the hand grip when the latter is moved away from the tube by the user.

2. A wrist exerciser comprising:

a) a support for supporting an arm of a user;

b) a hand grip pivotally coupled to the support;

c) a tube including a first end secured to the support adjacent the hand grip and a second end distal to the hand grip;

d) a first disc slidably disposed in the tube;

e) at least one cable connecting the first disc and the hand grip;

f) means for biasing the first disc away from the hand grip;

g) a barrel rotatably secured to the second end of the tube;

h) a bolt rotatably disposed in the tube and including a first end positioned at the first end of the tube and a second end secured to the barrel for rotation therewith;

i) a second disc threadedly engaged with the bolt, the biasing means being disposed between the first and second discs, and the second disc being moveable towards and away from the first disc upon rotation of the bolt by the barrel for varying the biasing force applied to the hand grip when the latter is moved away from the tube by the user; and j) the first and second discs each including at least one notch formed therein, the cable being engaged within the notches of the discs and the cable including a head for securing the cable to the first disc.

3. A wrist exerciser comprising:

a) a support for supporting an arm of a user;

b) a hand grip pivotally coupled to the support;

c) a tube including a first end secured to the support adjacent the hand grip and a second end distal to the hand grip;

d) a first disc slidably disposed in the tube;

e) at least one cable connecting the first disc and the hand grip;

f) means for biasing the first disc away from the hand grip;

g) a barrel rotatably secured to the second end of the tube;

h) a bolt rotatably disposed in the tube and including a first end positioned at the first end of the tube and a second end secured to the barrel for rotation therewith;

i) a second disc threadedly engaged with the bolt, the biasing means being disposed between the first and second discs, and the second disc being moveable towards and away from the first disc upon rotation of the bolt by the barrel for varying the biasing force applied to the hand grip when the latter is moved away from the tube by the user; and j) the bolt includes a head formed on the second end thereof, the tube includes two pins disposed in parallel in the second end thereof, and the pins being engaged with the bolt adjacent the head thereof for permitting rotation of the bolt and tube.

4. A wrist exerciser comprising:

a) a support for supporting an arm of a user;

b) a hand grip pivotally coupled to the support;

c) a tube including a first end secured to the support adjacent the hand grip and a second end distal to the hand grip;

d) a first disc slidably disposed in the tube;

e) at least one cable connecting the first disc and the hand grip;

f) means for biasing the first disc away from the hand grip;

g) a barrel rotatably secured to the second end of the tube;

h) a bolt rotatably disposed in the tube and including a first end positioned at the first end of the tube and a second end secured to the barrel for rotation therewith;

i) a second disc threadedly engaged with the bolt, the biasing means being disposed between the first and second discs, and the second disc being moveable towards and away from the first disc upon rotation of the bolt by the barrel for varying the biasing force applied to the hand grip when the latter is moved away from the tube by the user; and j) the barrel includes a plurality of recesses arranged in an annular circular configuration therein, the tube includes a cavity formed in the second end thereof, a catch engaged within the cavity and means for biasing the catch into engagement with the recesses for maintaining the barrel in place relative to the tube.

* * * * *